US007048160B2

(12) United States Patent
Anderson

(10) Patent No.: US 7,048,160 B2
(45) Date of Patent: May 23, 2006

(54) INFANT FEEDING AND ENTERTAINMENT SUPPORT

(76) Inventor: Antonio D. Anderson, 1300 Scenic Brook Trail, Conyers, GA (US) 30094

( * ) Notice: Subject to any disclaimer, the term of this patent is extended or adjusted under 35 U.S.C. 154(b) by 78 days.

(21) Appl. No.: 10/374,360

(22) Filed: Feb. 25, 2003

(65) Prior Publication Data

US 2004/0164107 A1 Aug. 26, 2004

(51) Int. Cl.
*A45F 3/16* (2006.01)

(52) U.S. Cl. ..... 224/148.6; 224/576; 224/623; 224/626; 2/46; 2/48

(58) Field of Classification Search .. 224/148.4–148.6, 224/576, 603, 604, 623, 625, 626, 901.8; 2/46, 48, 49.1, 49.2, 49.4, 49.5, 104; 248/102
See application file for complete search history.

(56) References Cited

U.S. PATENT DOCUMENTS

| | | | | | |
|---|---|---|---|---|---|
| 2,262,010 | A | * | 11/1941 | Kuehne | 2/49.2 |
| 2,425,635 | A | * | 8/1947 | Nitzberg | 2/75 |
| 2,482,182 | A | * | 9/1949 | Henninger | 2/48 |
| 2,907,539 | A | | 10/1959 | Vardan | |
| 3,144,230 | A | | 8/1964 | Brooks | |
| 3,601,815 | A | * | 8/1971 | Strehlan | 2/48 |
| 3,850,393 | A | | 11/1974 | Marquard | |
| 3,977,638 | A | | 8/1976 | Woodard | |
| 4,079,465 | A | * | 3/1978 | Alexander | 2/48 |
| 4,220,302 | A | | 9/1980 | Hampton et al. | |
| 4,569,086 | A | * | 2/1986 | Takefman | 2/49.2 |
| 4,710,979 | A | * | 12/1987 | Bull et al. | 2/48 |
| 4,712,251 | A | * | 12/1987 | Cobble | 2/104 |
| 4,713,842 | A | * | 12/1987 | Patterson | 2/104 |
| 4,723,323 | A | * | 2/1988 | Wright, Jr. | 2/48 |
| 4,733,411 | A | * | 3/1988 | Foti | 2/49.1 |
| 4,924,528 | A | * | 5/1990 | Trombetti-Dickens | 2/104 |
| 5,008,960 | A | * | 4/1991 | Hemming | 2/104 |
| 5,312,282 | A | * | 5/1994 | Cooper | 446/27 |
| 5,509,141 | A | * | 4/1996 | Saltzman | 2/49.2 |
| 5,573,153 | A | * | 11/1996 | Stillman | 224/148.6 |
| 5,956,762 | A | * | 9/1999 | Adams | 2/48 |
| 5,960,471 | A | * | 10/1999 | Burton | 2/48 |
| 6,000,056 | A | * | 12/1999 | Brady et al. | 2/49.1 |
| 6,049,909 | A | * | 4/2000 | Anderson | 2/111 |
| 6,216,274 | B1 | * | 4/2001 | Harris | 2/104 |
| 6,378,135 | B1 | * | 4/2002 | Hemming et al. | 2/104 |
| 6,490,731 | B1 | * | 12/2002 | Hyatt | 2/49.1 |
| RE38,393 | E | * | 1/2004 | Bronson | 2/102 |
| D492,091 | S | * | 6/2004 | Nakama-Mitsunaga | D2/861 |

* cited by examiner

*Primary Examiner*—Stephen K. Cronin
(74) *Attorney, Agent, or Firm*—Rodgers & Rodgers

(57) ABSTRACT

An infant feeding and entertainment support comprising a front panel and a rear panel detachably affixed thereto with the front panel alternatively adapted to include bottle feeding holder means, breast feeding veil means, burping cloth, as well as infant-oriented entertainment items.

8 Claims, 3 Drawing Sheets

INFANT FEEDING AND ENTERTAINMENT SUPPORT

BACKGROUND OF THE INVENTION

Infant bottle holders are known wherein the bottle is affixed in one way or another to a support thereby allowing the wearer to hold an infant with one hand and freeing the other hand to perform other tasks. It is also desirable to provide a support not only for bottles but also items in the form of novelties intended as focal points of the infant's attention.

SUMMARY OF THE INVENTION

By this invention, an infant feeding and entertainment support is provided and comprises a front panel, and a rear panel detachably affixed thereto, and the front panel having, alternatively, a bottle affixed thereto by appropriate fastening means or infant-oriented entertainment items affixed thereto.

DETAILED DESCRIPTION OF THE INVENTION

Figure 1:
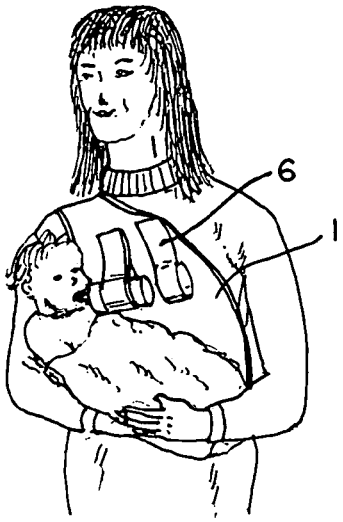
FIG. 1 is a perspective view of the support according to this invention with a bottle secured to the front panel thereof.
Figure 2:
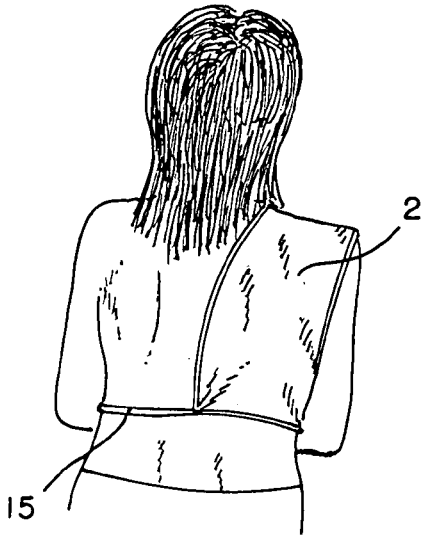
FIG. 2 is a rear elevational view of the support shown in FIG. 1.
Figure 3:
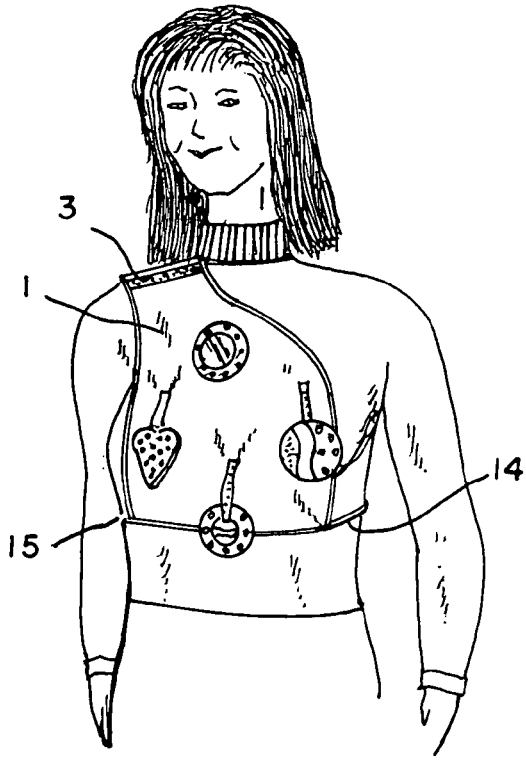
FIG. 3 is a view similar to FIG. 1 wherein entertainment items are secured to the front panel.

In the drawings, the numeral 1 designates the front panel of the infant feeding and entertainment support, with rear panel 2 secured thereto by means of Velcro fastener 3. Of course, other suitable fastening means could be utilized such as a zipper, buttons, tie strings, etc.

Figure 5:
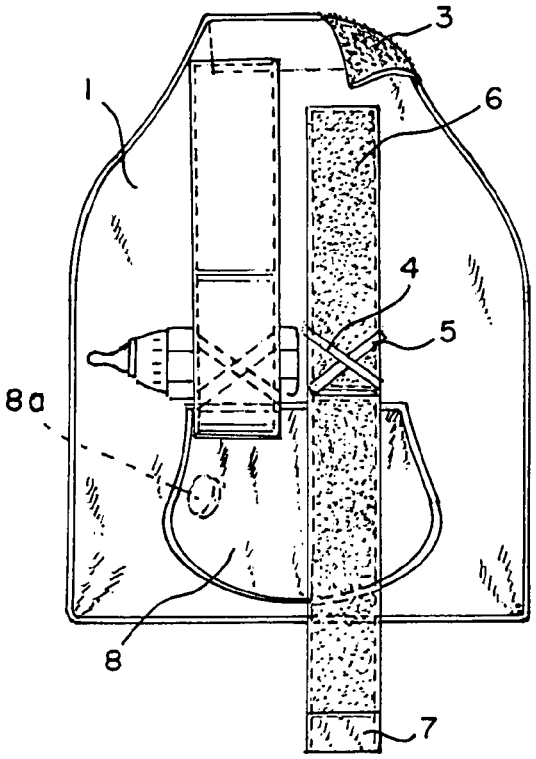
FIG. 5 is an elevational view showing the bottle holder means in detail.
Figure 6:
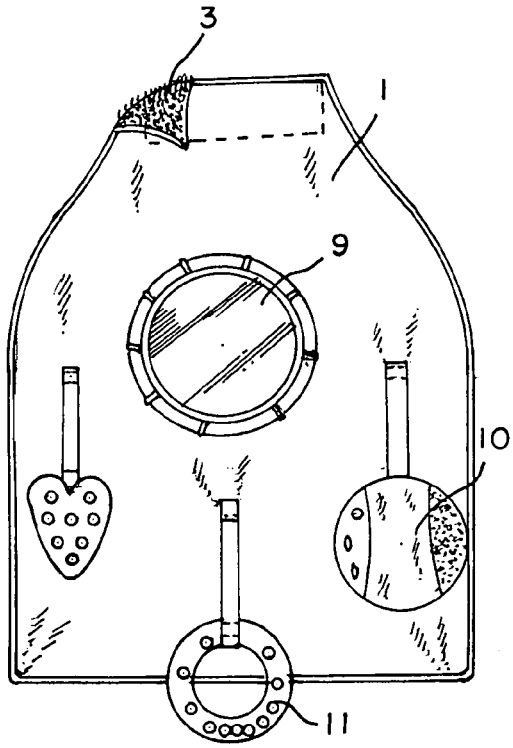
FIG. 6 is an elevational view showing details of the entertainment items affixed to the support.

As best shown in FIG. 5, the details of the bottle support means are shown wherein duplicate bottle holders are disposed side-by-side. Typically only one of the holders will be utilized, but a large bottle will require both holders. Since both holders are identical, only one will be described in detail. The primary bottle holding means is in the form of crisscrossed flexible bands 4 and 5, the ends of which are attached to front panel 1. Clearly, in use, the bottle is simply slid under flexible bands 4 and 5, as shown in FIG. 5. In order to provide additional security, strap 6 is provided and can be wrapped around the bottle with the free ends secured together by means of Velcro tab 7. Waterproof pouch 8 is attached to front panel 1 to receive bottle caps and the like. Also, music module 8*a* is imbedded within the fabric or plastic material of pouch 8. When music is desired, module 8*a* is simply manually pressed. This invention is also adaptable to a disposable or washable front panel for use as a conventional infant burping cloth.

When front panel 1 is not used for purposes of bottle feeding an infant, a separate panel is adapted as support means for infant-oriented entertainment items such as mirror 9, ball 10 and teething ring 11 which are secured to front panel 1 by means of thread and the like.

Figure 7:
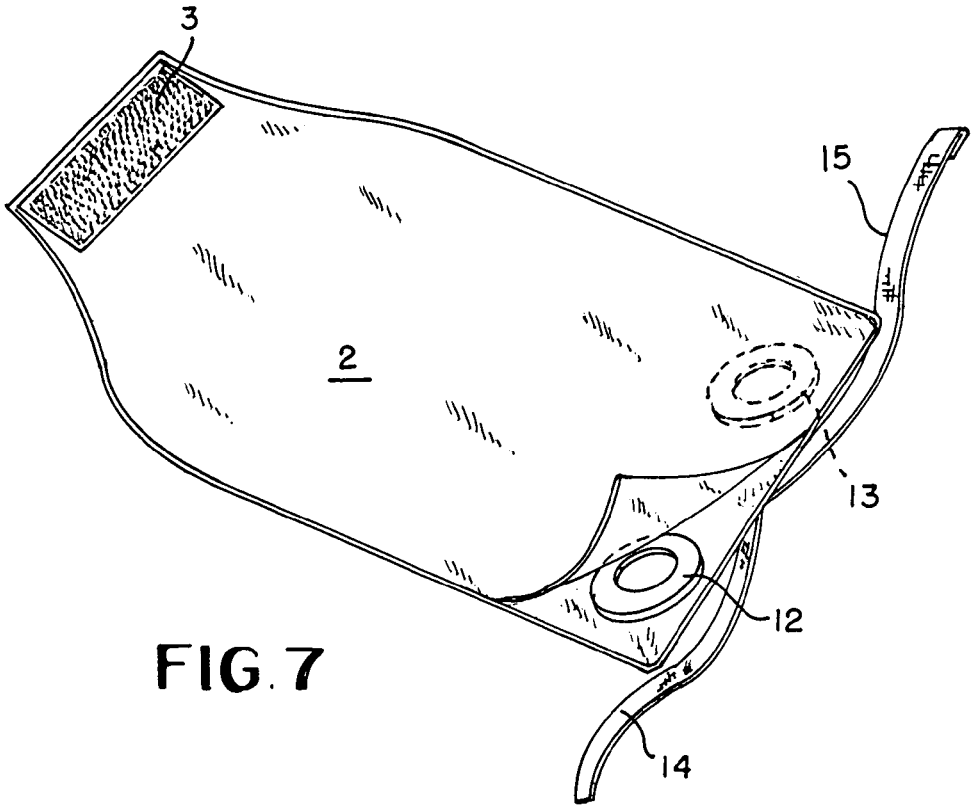
FIG. 7 is a perspective view showing details of the rear panel.

Due to the added weight of front panel 1, caused by the bottle holding means and the entertainment items, rear panel 2 includes metal weights 12 and 13 which are secured along the lower portion of rear panel 2, as best shown in FIG. 7. Also, in order to provide security for the support, supplemental straps 14 and 15 are provided which extend from the lower portion of rear panel 2 around the user's waist and are attachable, respectively, to the lower corners of front panel 1 by means of Velcro and the like. In addition, straps 14 and 15 are adaptable for typing the entire apparatus together when it is rolled up and transported in a diaper bag.

Figure 4:
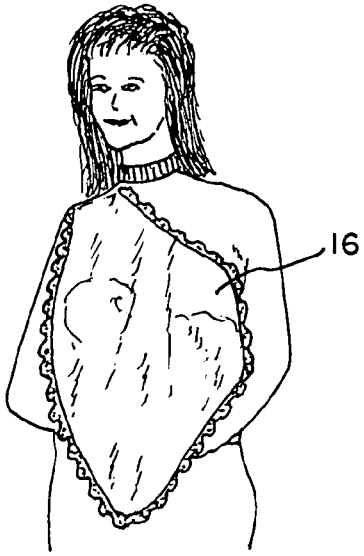
FIG. 4 is a perspective view showing the front panel in the form of a breast feeding veil.
Figure 8:
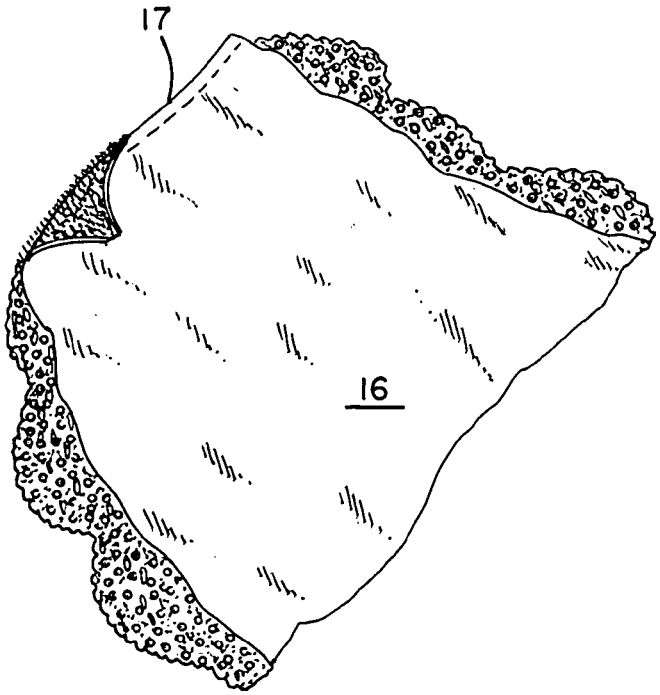
FIG. 8 is a perspective view showing details of the breast feeding veil.

A modification of the invention is shown in FIGS. 4 and 8 wherein breast feeding veil 16 is detachably secured to rear panel 2 by means of Velcro fastener 17. Therefore, by this invention, a support is provided for infant feeding to include bottle feeding means or, alternatively, breast feeding privacy means, as desired.

In summary, by this invention, a support is provided which is adaptable to providing one-handed bottle feeding or breast feeding veil means and is quickly adaptable to infant entertainment item support means when the infant is not being fed.

I claim:

1. An infant feeding and entertainment support comprising a front panel to overlie a user's front, a rear panel to overlie a user's back being detachably affixed thereto by fastening means to overlie a user's shoulders, said rear panel having a free end disposed opposite said front panel, a weight secured along the lower portion of said rear panel between said front panel and said free end, and bottle support means attached to said front panel and comprising a combination of crisscrossed flexible bands and a two-piece strap.

2. A support according to claim 1 wherein infant-oriented entertainment items are affixed to said front panel.

3. A support according to claim 1 wherein said front panel comprises a breast feeding veil.

4. A support according to claim 1 wherein said front panel and rear panels are detachably affixed by means of Velcro.

5. A support according to claim 1 wherein a pouch is secured to said front panel.

6. A support according to claim 5 wherein said pouch is waterproof.

7. A support according to claim 6 wherein a music module is imbedded in said pouch.

8. A support according to claim 1 wherein said front panel is disposable.

* * * * *